US005113972A

United States Patent [19]

Haak, Sr.

[11] Patent Number: 5,113,972

[45] Date of Patent: May 19, 1992

[54] SCISSOR-TYPE LIFTING DEVICE, PARTICULARLY FOR A WORK PLATFORM

[76] Inventor: Martin Haak, Sr., G. Schoolmeesterlaan 14, 2015 EM Haarlem, Netherlands

[21] Appl. No.: 392,063

[22] Filed: Aug. 10, 1989

[30] Foreign Application Priority Data

Aug. 10, 1988 [WO] PCT Int'l Appl. ... PCT/NL88/00038
Apr. 3, 1989 [DE] Fed. Rep. of Germany ... 8904060[U]

[51] Int. Cl.[5] ..... E04G 1/22

[52] U.S. Cl. ..... 248/141; 248/63; 248/69; 187/18

[58] Field of Search ..... 182/141, 63, 69, 148, 182/149; 187/18

[56] References Cited

U.S. PATENT DOCUMENTS

| | | | |
|---|---|---|---|
| 682,932 | 9/1901 | Haltom | 182/63 X |
| 1,261,633 | 4/1918 | Sheford | 182/63 |
| 1,448,932 | 3/1923 | Mayhugh . | |
| 1,592,770 | 7/1926 | Liberman | 182/141 |
| 2,402,579 | 6/1946 | Ross | 182/63 X |
| 3,621,940 | 11/1971 | Lodige | 187/18 |
| 4,576,249 | 3/1986 | Zima | 187/18 X |
| 4,930,598 | 6/1990 | Murrill | 182/141 X |

FOREIGN PATENT DOCUMENTS

| | | |
|---|---|---|
| 89389 | 9/1983 | European Pat. Off. . |
| 3151031 | 12/1981 | Fed. Rep. of Germany . |
| 3248414 | 12/1982 | Fed. Rep. of Germany . |
| 2317218 | 7/1976 | France . |
| 2385638 | 10/1978 | France . |
| 1502778 | 3/1978 | United Kingdom . |
| 88/00170 | 1/1988 | World Int. Prop. O. . |

*Primary Examiner*—Alvin C. Chin-Shue
*Attorney, Agent, or Firm*—Wigman & Cohen

[57] ABSTRACT

A scissor-type lifting device, for example for a work platform, with a scissor mechanism which has for one scissor axis 4 only two scissor arms a and b connected with each other so as to pivot about this scissor axis. The moments of torque that arise in the scissor arms produce prestresses in the mounts of the scissor axis and render the scissor mechanism free of play.

2 Claims, 2 Drawing Sheets

SCISSOR-TYPE LIFTING DEVICE, PARTICULARLY FOR A WORK PLATFORM

The invention relates to a scissor-type lifting device, particularly for a work platform, having a lower frame an upper frame a scissor mechanism that connects the two frames, the scissor unit of which has two scissor arms, each of which has, approximately in its center, a mount for a scissor bolt which hingedly connects the two scissor arms with each other about an intended scissor axis, and each of scissor arms has connecting mounts at its ends to receive connecting bolts that connect these ends with the mentioned frames and/or with the ends of the scissor arms of an additional scissor unit, and a drive means for the scissor mechanism.

One difficulty in existing scissor-type lifting devices of this type is that the two ends of the scissor arms of the scissor device are subjected to opposite moments of torque by the transfer of force through the scissor bolts. This torque loading results in a twisting of the hinge connections, whereby large frictional forces arise there which severely reduce the degree of efficiency of the scissor drive means and sometimes jam these hinge connections and thereby the entire scissor mechanism. In order to avoid such a twisting or keep it as minimal as possible, it is known, as is described for example in DE-OS 35 27 324, to provide two parallel scissor units for each scissor mechanism with an intended single scissor axis, in order to avoid a bending or tipping of the scissor mechanism about a horizontal axis lying perpendicular to the axes of the hinge connections of the scissor arms, and thus to avoid a twisting of the hinge connections.

The object of the invention is to create a scissor-type lifting device for a work platform having the above-mentioned characteristics which has a substantially simpler construction.

The object is achieved according to the invention with a scissor-type lifting device with the above-mentioned characteristics in that for each intended scissor axis a single scissor mechanism with only two scissor arms is provided, so that the moments of torque arising therefrom cause stresses of said bolts in said mounts and thus render them free of play. This can be achieved in one exemplary embodiment by means of the fact that the drive unit engages with one scissor arm at a distance from an intended center plane of the scissor mechanism, running between the scissor arms perpendicularly to the intended scissor axis. The same result can also be achieved with the following measure alone or also together with the previously mentioned measure by means of the fact that the free space between the scissor arms hingedly connected with each other is greater than 1/20 of the thickness of the profile of the scissor arm measured perpendicularly to the pivot axis, and preferably the above-referenced spacing is not greater than half the thickness of the scissor arm profile mentioned earlier.

Accordingly, the basis of the invention is to intentionally accept the twisting of the hinge connections. In this manner the possibility is created that in a scissor mechanism for a work platform, for example, having at least two scissor axes intended to be arranged one above the other only one scissor unit is provided for each scissor axis.

By appropriately selecting the size of the cross-sections of the scissor arms and the length of the mounts of the hinge connections running through the scissor arm, hinge connections are created that are prestressed under load in the sense of a twisting and which make possible, with an appropriately selected drive means, the moveability of the scissor mechanism despite the twisting. Surprisingly, however, this prestressing creates hinge connections that are free of play, which results in a very rigid construction of the scissor mechanism, so that a scissor mechanism for a scissor-type lifting device can be used with multiple scissor axes, arranged one above the other, in which only a single scissor unit is required for each scissor axis without fear that the scissor mechanism will bend laterally to the anticipated central plane and the resulting tipping of the scissor-type lifting device.

The invention thus intentionally accepts a reduction in the degree of efficiency of the scissor drive in order to thereby create a very simple yet stable construction of a scissor-type lifting device. However, because the drive ratios are at their worst when the scissor mechanism is collapsed, i.e., when the upper frame is completely lowered, for example, when a hydraulic cylinder is used as the drive means, in one advantageous embodiment of the invention it is provided that, at least on the scissor arm with which the drive means is connected, the scissor axis is arranged at a distance above the plane defined by the connecting axes at the ends of this lever arm. In this manner, more favorable lever ratios are created for transferring the force of the drive means to the scissor mechanism. It has proven advantageous to provide these measures in all of the scissor arms of the scissor mechanism.

The invention is described in greater detail in the following description of an exemplary embodiment of a work platform described as shown in the drawing.

Shown are:

Figure 1:
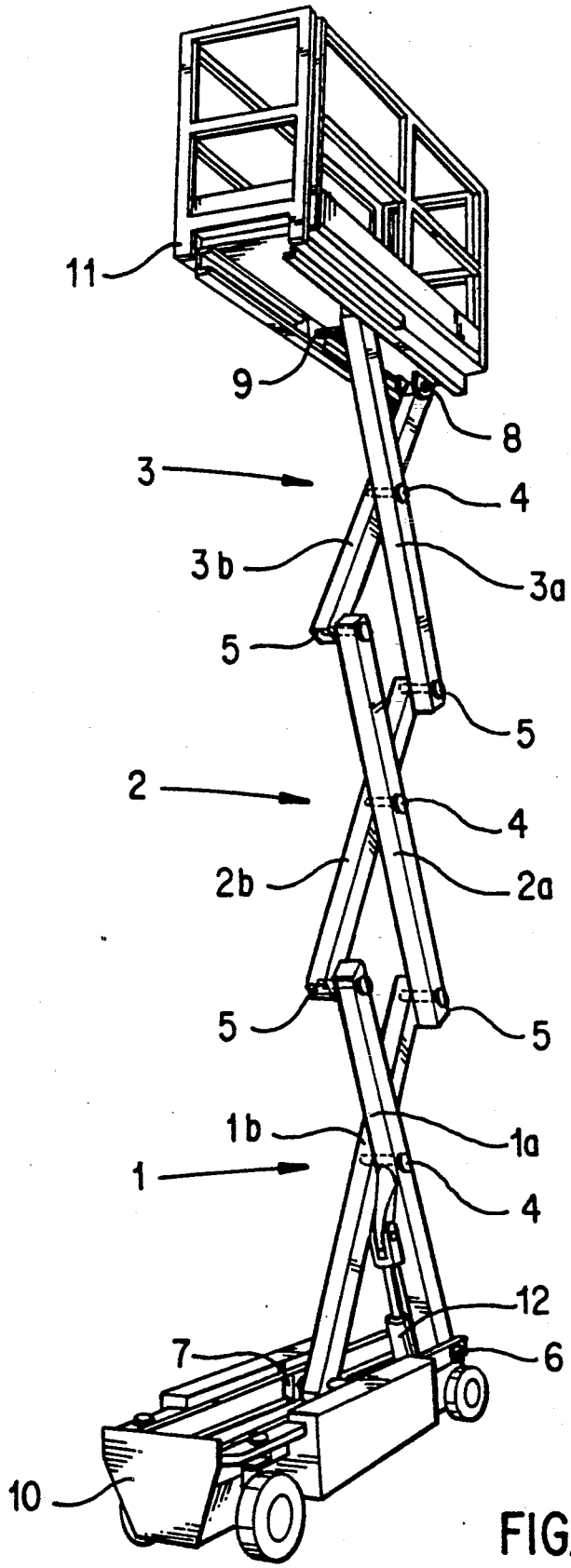
FIG. 1 is an illustrative depiction of the exemplary embodiment with an upwardly extended work platform.

The scissor-type lifting device for a work platform illustrated in the drawings has a scissor mechanism having three scissor axes 4, arranged one above the other, of three scissor units 1, 2 and 3. The scissor mechanism connects a lower frame 10 with an upper frame 11. Each of these scissor units 1, 2 and 3 consists of only two scissor arms 1*a* and 1*b* or 2*a* and 2*b* as well as 3*a* and 3*b*, respectively, which are hingedly connected with each other in their centers so as to pivot about a scissor axis 4. The scissor arms are hollow and square in cross-section.

Each scissor arm a and b of one scissor unit is hingedly connected at at least one of its ends with the end of a scissor arm b or a, respectively, of an adjacent scissor unit so as to pivot about a connecting axis 5.

The hinged connections with the axes 5 are constructed precisely like the hinged connections with the axes 4.

The lower end of the lever arm 1*a* is connected with the lower frame 10 so as to pivot about an axis 6, which lower frame 10 in the illustrated exemplary embodiment is formed as a chassis that travels on wheels.

The lower end of the scissor arm 1b of the lowermost scissor unit 1 can pivot about an axis 7 and is slidably connected with the lower frame 10.

A drive means 12, which in the illustrated exemplary embodiment is formed as a hydraulic cylinder, has a cylinder that is pivotably connected with the lower frame 10. The piston rod of the drive means 12 engages at a point of attack below the scissor axis 4 of the scissor arm 1a.

The upper end of the scissor arm 3b is connected with the upper frame 11, which supports a work platform, so as to pivot about an axis 8. The upper end of the scissor arm 3a is slidably connected with the upper frame 11 so as to pivot about an axis 9.

Figure 2:
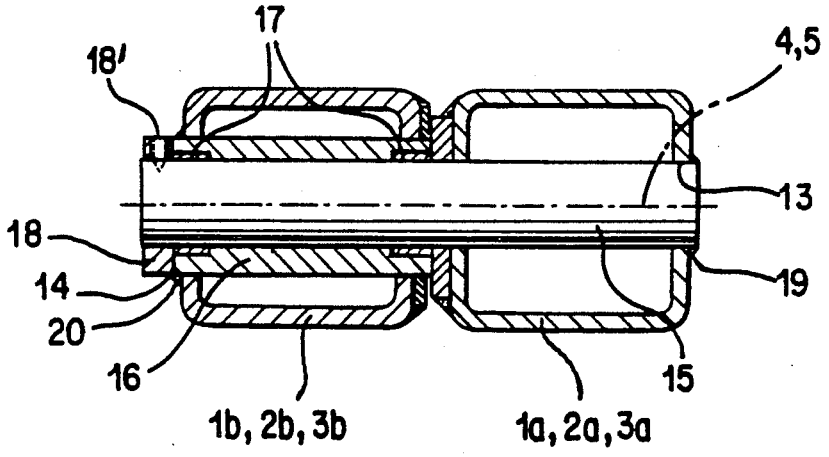
FIG. 2 is an axial section through a hinge connection of the scissor arm of the scissor mechanism.

Because all of the hinge connections between the scissor arms are formed identically, one of these connections is shown in FIG. 2 in axial cross-section along an axis 4 or 5.

The scissor arms 1a, 2a and 3a have bores 13 for mounting bolts 15, which are rigidly connected with the outside of the corresponding scissor arms 1a, 2a or 3a by respective weld seams 19. The sleeves 16 are secured in the bores 14 with the scissor arms 1b, 2b and 3b on the outside thereof by means of weld seams 20.

The scissor arms 1b, 2b and 3b have bores 14 for sleeves 16 which are provided with a respective press-fit mounting sleeve 17 for the mounting bolts 15.

Figure 3:
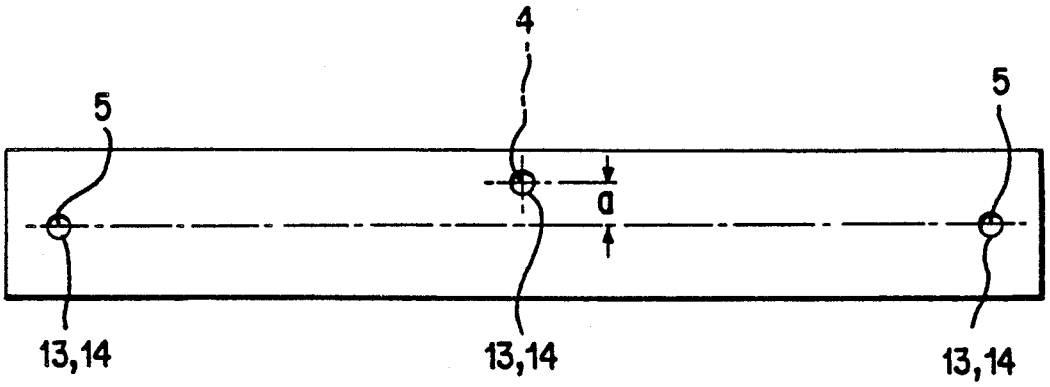
FIG. 3 is a side view of a scissor arm.

As can be seen from FIG. 3, in all of the scissor arms 1a, 2a and 3a, as well as 1b, 2b and 3b, the center bores 13 and 14, respectively, for the scissor axes 4 are arranged at a spacing distance a above the plane defined by the connecting axes 5 at the ends of the scissor arms. With this arrangement of the scissor axes 4, more favorable lever ratios are provided for the point of engagement of the drive means 12 when the upper frame 11 is in its lowered condition.

During assembly of the scissor mechanism, the mounting bolts 15 that are rigidly connected with the scissor arms 1a, 2a and 3a are inserted into the corresponding mounting sleeves 17 of the scissor arms 1b, 2b and 3b and are secured by retaining rings 18, which are secured to the bolts 15 by screws 18'.

Because the drive means 12 acts on a scissor arm, namely the scissor arm 1a, the opposing tortional forces that act on the two ends of the scissor arm are not reduced, but rather increased. By this means, especially the hinged connections on the axes 5 are prestressed toward twisting. The resulting play-free joints give the entire scissor mechanism an increased stiffness, so that additional support from a parallel scissor mechanism is not necessary to support the lifting platform. This results in a very simple construction of the scissor-type lifting device.

Figure 4:
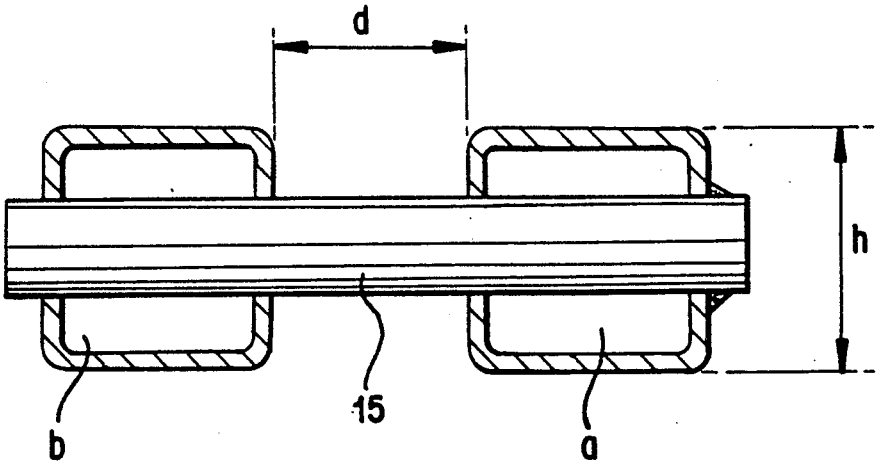
FIG. 4 is a schematic illustration of a hinge connection of the scissor arms.

The same result can be achieved either together with the above-described arrangement of the point of attack of the drive means 12 or, also alone, with a different arrangement thereof with the following measure. This alternative measure is that the free space d of the hingedly-connected scissor arm a and b of one scissor unit, as illustrated in FIG. 4, is greater than 1/20 of the thickness h of the cross-section of the scissor arm measured perpendicularly to the hinge axis 4, 5, and no greater than half of this cross-sectional thickness h.

The present specification and the drawings are limited only to the description of characteristics that are material to the exemplary embodiment of the invention. Therefore, to the extent that characteristics are disclosed in the specification and in the drawings and are not mentioned in the claims, they also serve to establish the object of the claims.

I claim:

1. A work platform comprising:

a lower frame;

an upper frame;

a scissor mechanism that connects said upper frame and said lower frame one above the other; and a drive means for actuating said scissor mechanism to lift said upper frame with respect to said lower frame;

and scissor mechanism comprising a lower, an upper and at least one intermediate scissor units; wherein each of said scissor units has a first and a second arm;

each of said arms has a lower and an upper end and a mid point located approximately in the middle between said lower and said upper ends;

said mid points of the first and second arms of each of the scissor units being respectively hingedly connected by a joint defining a horizontal scissor axis;

said lower end of said first arm of said lower scissor unit being hingedly connected to said lower frame by a first lower joint so as to pivot about a lower first axis which extends parallel to said horizontal scissor axis of said lower scissor unit;

said lower end of said second arm of said lower scissor unit being connected to said lower frame by a second lower joint so as to pivot about a lower second axis which extends parallel to said lower first axis and to slide along said lower frame in a direction perpendicular to said lower second axis;

said upper end of said first arm of said upper scissor unit being hingedly connected to said upper frame by a first upper joint so as to pivot about an upper first axis which extends parallel to said horizontal scissor axis of said upper scissor unit;

said upper end of said second arm of said upper scissor unit being hingedly connected to said upper frame by a second upper joint so as to pivot about an upper second axis which extends parallel to said upper first axis and to slide along said upper frame in a direction perpendicular to said upper second axis;

said lower and upper ends of said arms of said intermediate scissor unit being laterally connected, respectively, to said upper ends of said arms of said lower scissor unit and to said lower ends of said arms of said upper scissor unit by joints, so that said horizontal scissor axis of said upper, intermediate and lower scissor units are arranged one above the other;

wherein for each said scissor axis only one of said scissor units is provided for producing moments of torque in said arms of said scissor units, which moments of torque cause prestresses in said joints and thus render said joints free of play; and the scissor mechanism which connects the upper and lower frame contains only one series of at least three scissor units arranged one above the other wherein one scissor unit contains only two arms hingedly connected one to other;

wherein said drive means connects the lower frame with the lower scissor unit;

wherein the drive means acts on one of the scissor arms of the lowermost scissor unit at a distance from the horizontal scissor axis of said lower scissor unit; and wherein further the upper and lower ends of the first scissor arm of the lower scissor unit, with which drive means is connected, are provided with connecting mounts to receive connecting bolts, and the mid-point of the first arm of the lower scissor unit is provided with a connecting mount to receive a connecting bolt arranged at a distance (a) above the plane defined by the axes of the connecting bolts at the end of this scissor arm.

2. The work platform according to claim 1, wherein the drive means acts on the first scissor arm within the range of the center thereof.

* * * * *